US011648567B2

(12) United States Patent
Chen et al.

(10) Patent No.: US 11,648,567 B2
(45) Date of Patent: May 16, 2023

(54) AUTOMATIC SHREDDER HAVING PAPER PRESSING MECHANISM

(71) Applicant: Aurora Office Equipment Co., Ltd. Shanghai, Shanghai (CN)

(72) Inventors: Guanglong Chen, Shanghai (CN); Yung Kang Tso, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 0 days.

(21) Appl. No.: 17/179,338

(22) Filed: Feb. 18, 2021

(65) Prior Publication Data

US 2022/0126301 A1 Apr. 28, 2022

(30) Foreign Application Priority Data

Oct. 22, 2020 (CN) ..... 202011128738.8

(51) Int. Cl.
*B02C 18/22* (2006.01)
*B02C 18/00* (2006.01)

(52) U.S. Cl.
CPC ..... *B02C 18/2233* (2013.01); *B02C 18/0007* (2013.01)

(58) Field of Classification Search
CPC ..... B02C 18/0007; B02C 2018/0023; B02C 2018/0046
See application file for complete search history.

(56) References Cited

U.S. PATENT DOCUMENTS 8,998,119 B2 * 4/2015 Zhan ..... B02C 18/2283 241/34
2005/0274836 A1 * 12/2005 Chang ..... B02C 18/0007 241/236
2011/0253824 A1 * 10/2011 Aries ..... B02C 18/2291 241/222
2012/0018554 A1 * 1/2012 Seo ..... B02C 18/2283 241/101.2

(Continued)

FOREIGN PATENT DOCUMENTS

CN 109046676 A * 12/2018 ..... B02C 18/0007
CN 109550556 A * 4/2019

OTHER PUBLICATIONS

English translate (CN109550556A), retrieved date Sep. 28, 2022.*

*Primary Examiner* — Adam J Eiseman
*Assistant Examiner* — Mohammed S. Alawadi
(74) *Attorney, Agent, or Firm* — WHGC, P.L.C.; John F. O'Rourke; Alexander R. Schlee

(57) ABSTRACT

Automatic paper shredder having a paper pressing mechanism, which includes upper shredder cover, lower shredder cover, paper support box, paper pressing plate, cover plate, spindle and two spindle holders. Upper cover is connected to lower cover. Paper support box is above the lower cover forming a cavity for to-be-shredded paper. Fixed ends of paper pressing plate and cover plate are around the spindle, so free ends of paper pressing plate and cover plate can rotate coaxially. Two ends of spindle are respectively disposed in two spindle holders, so spindle can rotate. Two spindle holders are connected to upper cover to connect cover plate and paper pressing plate to upper cover. Paper pressing plate is disposed below cover plate and for pressing to-be-shredded paper placed on paper support box when a user closes cover plate.

28 Claims, 14 Drawing Sheets

(56) References Cited

U.S. PATENT DOCUMENTS

| | | | | |
|---|---|---|---|---|
| 2013/0161425 | A1* | 6/2013 | Pan | B02C 18/0007 241/34 |
| 2013/0214072 | A1* | 8/2013 | Wu | B02C 18/0007 241/37.5 |
| 2013/0327862 | A1* | 12/2013 | Chang | B02C 18/2225 241/81 |
| 2014/0042254 | A1* | 2/2014 | Zhan | B02C 18/2283 241/34 |
| 2014/0103151 | A1* | 4/2014 | Xu | B02C 18/0007 241/220 |
| 2016/0318031 | A1* | 11/2016 | Chang | B02C 18/2241 |
| 2018/0008987 | A1* | 1/2018 | Tsai | B02C 25/00 |
| 2018/0017425 | A1* | 1/2018 | Tso | B02C 18/16 |

* cited by examiner

AUTOMATIC SHREDDER HAVING PAPER PRESSING MECHANISM

TECHNICAL FIELD

The invention relates, in general, to the field of automatic paper shredders and, in particular, to an automatic paper shredder having a paper pressing mechanism.

DESCRIPTION OF RELATED ART

Existing shredders with an automatic paper feed function typically include a paper pressing mechanism, a paper feed mechanism, a paper shredding mechanism and a driving mechanism which are mounted on a frame. A paper inlet is formed in a base plate located in a paper placement area. The paper shredding mechanism is located below the paper placement area and corresponds to the paper inlet in position. The paper feed mechanism is mounted at the paper inlet, folds paper along the paper inlet after the paper is pressed by the paper pressing mechanism, and conveys the folded paper to the paper shredding mechanism. The paper shredding mechanism shreds the paper, and the driving mechanism drives the paper feed mechanism and the paper shredding mechanism to operate.

The paper pressing mechanism includes a cover plate, a pressing plate flexibly mounted on the inner side of the cover plate, an elastic component mounted between the cover plate and the pressing plate, and a work chamber. The pressing plate is driven by the cover plate to move downwards to press against the paper under the effect of the elastic component. When such paper pressing mechanism is opened, the pressing plate will stretch out with respect to the cover plate, so that the size is large, and the appearance is affected. On the other hand, because the elastic component is arranged between the cover plate and the pressing plate, users have to overcome the elastic force of the elastic components to press the cover plate downwards, so that operation is difficult. In addition, if the cover plate fails to be completely closed or comes loose when needing to be closed to shield the paper placement area, the pressing plate will not be able to press the paper, or the pressing plate may eject the cover plate open during paper shredding, thus resulting in an accident and a shutdown.

BRIEF SUMMARY OF THE INVENTION

The defects of the prior art can be overcome by providing an automatic shredder having a paper pressing mechanism to solve the problems of unreasonable structure, inconvenient operation and insufficient paper pressing force of paper pressing structures.

To that end, the invention discloses a paper pressing mechanism for an automatic shredder, comprising a cutting mechanism, an upper shredder cover, a lower shredder cover, a paper support box, a paper pressing plate, a cover plate, a spindle and two spindle holders. The upper shredder cover is vertically and fixedly connected to the lower shredder cover. The paper support box is concavely disposed above the lower shredder cover to form an accommodating cavity for accommodating a stack of to-be-shredded paper. Fixed ends of the paper pressing plate and the cover plate are disposed around the spindle, so that free ends of the paper pressing plate and the cover plate are able to rotate coaxially. Two ends of the spindle are respectively disposed in the two spindle holders, so that the spindle is able to rotate. The two spindle holders are fixedly connected to the upper shredder cover to fixedly connect the cover plate and the paper pressing plate to the upper shredder cover. The paper pressing plate is disposed below the cover plate and is used for pressing the stack of to-be-shredded paper placed on the paper support box when a user closes the cover plate.

Furthermore, the paper pressing mechanism further has at least one limiting assembly including a positioning aperture, a positioning column, an elastic component and a stop component.

The positioning aperture is formed in the paper pressing plate. The positioning column matches the positioning aperture in position and has an end fixed to an inner side of the cover plate and an end penetrating through the positioning aperture. The stop component is connected to the end, away from the cover plate, of the positioning column and has a peripheral size greater than the diameter of the positioning aperture, so that the free end of the paper pressing plate is able to move between the two ends of the positioning column. The elastic component has an end fixed to a lower surface of the paper pressing plate and an end fixed to the spindle. When the user opens the cover plate, the stop component drives the paper pressing plate to turn upwards along the positioning column, and the elastic component is in a stretched state. When the user closes the cover plate, the elastic component contracts to automatically drive the paper pressing plate to turn downwards along the positioning column to enable the paper pressing plate to press against an upper surface of the stack of to-be-shredded paper, and the elastic component is in a contracted state.

The paper pressing mechanism may include two limiting assemblies having two positioning apertures, two positioning columns, two elastic components and two stop components. The two positioning apertures are symmetrically formed in the paper pressing plate. The two positioning columns have one ends symmetrically disposed on the inner side of the cover plate and the other ends respectively penetrating through the two positioning apertures and matching the two positioning apertures in position. The two stop components are respectively connected to the ends, away from the cover plate, of the two positioning columns and have peripheral sizes corresponding to the diameters of the two positioning apertures. The two elastic components have one ends fixed to the lower surface of the paper pressing plate and the other ends connected to the spindle in a hooked manner.

The elastic component is a tension spring having an end fixedly connected to an elastic component holder on the lower surface of paper pressing plate and the other end connected to the spindle in a hooked manner. When the number of the tension springs is two or more, the distances from joints of one ends of the plurality of tension springs and the elastic component holders to the spindle are equal, and the distances from the joints of one ends of the plurality of tension springs and the elastic component holders to the lower surface of the paper pressing plate are also equal, so that tensile forces applied to different positions of the paper pressing plate by the tension springs are uniform. The positioning aperture can be linear, oval or oblong. Long edges of the positioning aperture are perpendicular to the long axis of the spindle. The positioning column and the cover plate are manufactured integrally. The stop component is a screw, a nut, a bolt, a clamping pin, a positioning pin, or a stop pin. Furthermore, the paper pressing mechanism further includes at least one paper pick-up roller set including an upper paper pick-up roller and a lower paper pick-up roller.

The upper paper pick-up roller is fixed between two upper paper pick-up roller seats at a lower end of the paper pressing plate through an upper paper pick-up roller spindle. The lower paper pick-up roller is fixed to two sides of the lower shredder cover or between two lower paper pick-up roller seats at a lower end of the paper support box through a lower paper pick-up roller spindle. The lower paper pick-up roller partially protrudes out of an upper surface of the paper support box and corresponds to the upper paper pick-up roller in position, so that when the user closes the cover plate, the upper paper pick-up roller on the paper pressing plate presses against the stack of to-be-shredded paper on the paper support box and coordinates with the lower paper pick-up roller to enable one or more bottom pieces of paper in the stack of to-be-shredded paper to enter a paper inlet in the paper support box. The paper pressing mechanism has one paper pick-up roller set, in which the upper paper pick-up roller is located on a middle section of an inner side of the paper pressing plate, and the lower paper pick-up roller set is located on a middle section of one side of the paper inlet in the paper support box and corresponds to the upper paper pick-up roller in position. The paper pressing mechanism includes two paper pick-up roller sets which are symmetrically distributed on the inner side of the paper pressing plate and on one side of the paper inlet in the paper support box, respectively. The upper paper pick-up roller spindle is parallel to the lower surface of the paper pressing plate, and the lower paper pick-up roller spindle is parallel to the upper surface of the paper support box. The paper pressing mechanism further includes two torsion springs which are separately disposed around the two ends of the spindle and are respectively arranged in the two spindle holders at the two ends of the spindle to realize the rotation of the spindle.

The invention further discloses an automatic shredder, comprising a paper pressing structure, an upper shredder cover, a lower shredder cover, a paper support box, a shredder cover, a paper pressing base plate, a base plate spindle, big pressing plate torsion springs, a pressing plate spindle, a big pressing plate, two spindle torsion springs, two base plate spindle holders and two pressing plate spindle holders. The upper shredder cover is vertically and fixedly connected to the lower shredder cover. The paper support box is concavely disposed above the lower shredder cover to form an accommodating cavity for accommodating a stack of to-be-shredded paper. The shredder cover is connected to one end of the upper shredder cover through a pivot and is used for opening or closing the shredder.

One end of the paper pressing base plate is fixedly connected to the base plate spindle. The two spindle torsion springs are separately disposed around two ends of the base plate spindle and are respectively arranged in the two base plate spindle holders at the two ends of the base plate spindle, so that the base plate spindle is able to rotate to drive the paper pressing base plate to rotate. The two base plate spindle holders are fixedly connected to an inner side of the shredder cover to fixedly connect the paper pressing base plate to the inner side of the shredder cover. The two big pressing plate torsion springs are separately disposed around two ends of the pressing plate spindle and are respectively arranged in the two pressing plate spindle holders at the two ends of the pressing plate spindle, so that the pressing plate spindle is able to rotate to drive the big pressing plate to rotate.

The big pressing plate is rotatably connected to the paper pressing base plate from below through the pressing plate spindle and is used to pressing the stack of to-be-shredded paper placed on the paper support box when a user closes the shredder cover. The base plate spindle is disposed away from a pivot joint of the shredder cover and the upper shredder cover. The paper pressing structure further includes at least one paper pick-up roller set including an upper paper pick-up roller and a lower paper pick-up roller. The upper paper pick-up roller is fixed between two upper paper pick-up roller seats at the end, away from the base plate spindle, of the paper pressing base plate through an upper paper pick-up roller spindle. The lower paper pick-up roller is fixed to two sides of the lower shredder cover or between two lower paper pick-up roller spindle holders at a lower end of the paper support box through a lower paper pick-up roller spindle. The lower paper pick-up roller partially protrudes out of an upper surface of the paper support box and corresponds to the upper paper pick-up roller in position, so that when the user closes the cover plate, the upper paper pick-up roller on the paper pressing base plate presses against the stack of to-be-shredded paper on the paper support box and coordinates with the lower paper pick-up roller to enable one or more bottom pieces of paper in the stack of to-be-shredded paper to enter a paper inlet in the paper support box.

Furthermore, a paper pressing strip is disposed at the end, away from the base plate spindle, of the paper pressing base plate, is integrated with the paper pressing base plate, and is used for pressing a few pieces of to-be-shredded paper on the paper support box to the upper surface of the paper support box. The big pressing plate includes a big connecting plate and a big paper pressing plate, and the big paper pressing plate is, when the paper pressing base plate is naturally released, attached to the upper surface of the paper support box to press the stack of to-be-shredded paper to the upper surface of the paper support box. A first through-aperture is formed in the big paper pressing plate and matches a travel switch, partially upward protruding out of the paper support box, in position, so that when the stack of to-be-shredded paper on the paper support box is about to be completely shredded or has been completely shredded, the travel switch can be received in the first through-aperture and can feed back the paper shredding condition in time. In some embodiments, an angle between the big connecting plate and the big paper pressing plate is greater than or equal to 90 degrees. In other embodiments, the big connecting plate and the big paper pressing plate are manufactured integrally.

Moreover, the big pressing plate is divided into a plurality of small pressing plates each including a small connecting plate and a small paper pressing plate, and each small paper pressing plate is, when the paper pressing base plate is naturally released, attached to the upper surface of the paper support box to press the stack of to-be-shredded paper to the upper surface of the paper support box. When the pressing plate spindle is of an integrated structure, the small connecting plates of the plurality of small pressing plates are fixedly connected to the pressing plate spindle, and are fixedly connected to the paper pressing base plate through the big pressing plate torsion springs and the pressing plate spindle holders at the two ends of the pressing plate spindle. Alternately, when the pressing plate spindle is divided into a plurality of small pressing plate spindles, the number of the small pressing plate spindles is equal to that of the small pressing plates, the small connecting plates of the plurality of small pressing plates are fixedly connected to the plurality of small pressing plate spindles respectively, and are fixedly connected to the paper pressing base plate through small pressing plate torsion springs and small pressing plate spindle holders at two ends of the small pressing plate spindles.

Additionally, a second through-aperture is formed in the small paper pressing plate, located in a middle, of the plurality of small paper pressing plates and matches a travel switch, partially upward protruding out of the paper support box, in position, so that when the stack of to-be-shredded paper on the paper support box is about to be completely shredded or has been completely shredded, the travel switch can be received in the second through-aperture and can feed back the paper shredding condition in real time. In some embodiments, angles between the small connecting plates and the small paper pressing plates are equal and are greater than or equal to 90 degrees. In other embodiments, each small connecting plate and the corresponding small paper pressing plate are manufactured integrally.

By adoption of the above solutions, the embodiments of the invention have the following advantages and beneficial effects compared with the prior art. First, according to the paper pressing mechanism for an automatic shredder, through the cooperation of the positioning column on the inner side of the cover plate and the positioning aperture in the paper pressing plate, the paper pressing plate can be directly driven to turn when users open the cover plate, and the upper paper pick-up roller on the inner side of the paper pressing plate can press a stack of to-be-shredded paper on the paper support box by means of the contraction of the tension spring on the inner side of the paper pressing plate, so that the paper pressing effect and the paper pick-up efficiency can be effectively improved.

Second, according to the paper pressing structure for an automatic shredder, when users open the shredder cover, the paper pressing base plate will be naturally released under gravity; a stack of to-be-shredded paper is placed on the paper support box, then the shredder cover is closed, the big pressing plate (or the plurality of small pressing plates) on the paper pressing base plate presses against the upper surface of the stack of to-be-shredded paper, and the paper pressing base plate is squeezed to return. With the decrease of the stack of to-be-shredded paper, the paper pressing base plate descends, the upper paper pick-up roller gradually presses the upper surface of the stack of to-be-shredded paper, and the paper pressing strip presses against the upper surface of the stack of to-be-shredded paper at the same time, so that the paper pressing effect and the paper pick-up efficiency can also be effectively improved.

Third, compared with existing paper pressing structures provided with compression springs occupying a large space and a paper pressing plate having a large overall thickness, the two solutions above effectively simplify the structure, decrease the overall thickness of the paper pressing plate, reduce the moving distance of the paper pressing plate, and have the characteristics of ingenious design, reasonable structure, easy operation, large paper pressing force, high paper pick-up efficiency, and the like, thus being suitable for wide application and popularization on the market.

BRIEF DESCRIPTION OF THE DRAWINGS

To more clearly explain the technical solutions of the embodiments of the invention, drawings used for the description of the embodiments will be briefly introduced below. Obviously, the drawings in the following description are merely for illustrating some embodiments of the invention, and those skilled in the art can obtain other drawings according to the following ones without creative labor. In the Drawings.

Some embodiments are described in detail with reference to the related drawings. Additional embodiments, features and/or advantages will become apparent from the ensuing description or may be learned by practicing the invention. In the figures, which are not drawn to scale, like numerals refer to like features throughout the description. The following description is not to be taken in a limiting sense, but is made merely for the purpose of describing the general principles of the invention.

DETAILED DESCRIPTION OF THE INVENTION

Embodiments of the invention will be clearly and completely described and discussed below in conjunction with the accompanying drawings of the invention. Obviously, the embodiments in the following description are merely illustrative, and are not all possible ones of the application. All other embodiments obtained by those ordinarily skilled in the art on the basis of the following ones without creative labor should also fall within the protection scope of the application.

Representative Embodiment 1

Figure 10:
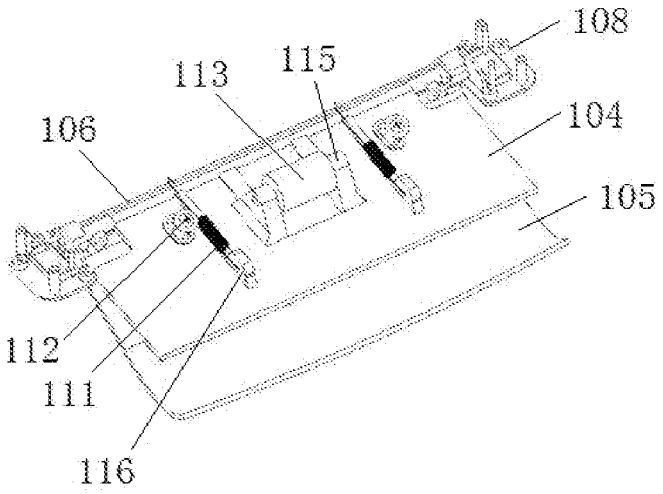
FIG. 10 is a bottom view of a matching structure of the cover plate and the paper pressing plate of the paper pressing mechanism for an automatic shredder embodiment of the invention.

As shown in FIG. 1-FIG. 11, the invention discloses an automatic shredder, having a paper pressing mechanism, which is commonly used in a case where user paper (e.g., Letter- or A4-size) cannot be flatly placed on a paper support box (similar to a compact automatic shredder), and includes a cutting mechanism, an upper shredder cover 101, a lower shredder cover 102, a paper support box 103, a paper pressing plate 104, a cover plate 105, a spindle 106, and two spindle holders 108. The upper shredder cover 101 is vertically and fixedly connected to the lower shredder cover 102. The paper support box 103 is concavely disposed above the lower shredder cover 102 to form an accommodating cavity for accommodating a stack of to-be-shredded paper. Fixed ends of the paper pressing plate 104 and the cover plate 105 are disposed around the spindle 106, so that free ends of the paper pressing plate 104 and the cover plate 105 are able to rotate coaxially. In this embodiment, as shown in FIG. 10, a joint of the cover plate 105 and the spindle 106 is located on an outer side of a joint of the paper pressing plate 104 and the spindle 106, so that the paper pressing plate 104 can be covered by the cover plate 105.

Figure 6:
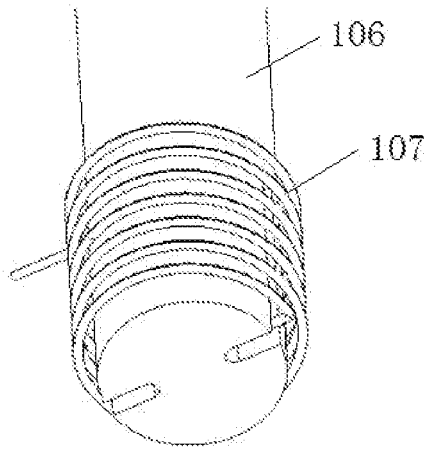
FIG. 6 is a matching diagram of a torsion spring and a spindle of the paper pressing mechanism for an automatic shredder embodiment of the invention.
Figure 7:
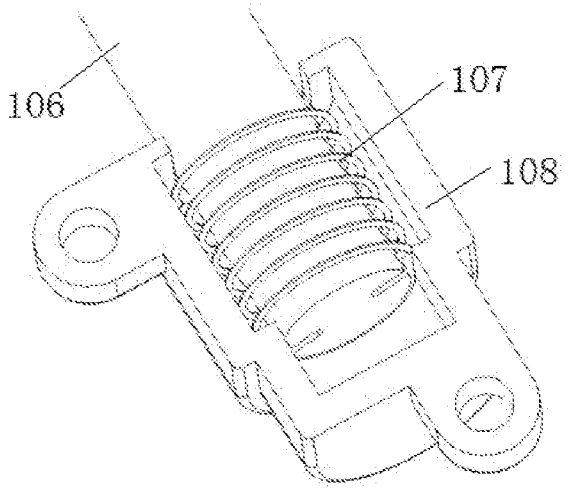
FIG. 7 is a matching diagram of the torsion spring and a spindle holder of the paper pressing mechanism for an automatic shredder embodiment of the invention.

Two ends of the spindle are respectively disposed in the two spindle holders, so that the spindle 106 is able to rotate. In this embodiment, the paper pressing mechanism further includes two torsion springs 107 which are separately disposed around the two ends of the spindle 106 and are respectively arranged in the two spindle holders 108 at the two ends of the spindle 106, as shown in FIG. 6 and FIG. 7. The rotating force of the torsion springs 107 at the two ends of the spindle 106 can be fully used to realize automatic return of the cover plate 105 after the cover plate 105 is opened by a user.

The two spindle holders 108 are fixedly connected to the upper shredder cover 101 to fixedly connect the cover plate 105 and the paper pressing plate 104 to the upper shredder cover 101. In this embodiment, the connection manner of the spindle holders 108 and the upper shredder cover 101 is not limited, and any fixed connection manners such as screwed connection, clamped connection and welded connection can be adopted. The paper pressing plate 104 is disposed below the cover plate 105 and is used for pressing the stack of to-be-shredded paper placed on the paper support box 103 when the user closes the cover plate 105.

Furthermore, the paper pressing mechanism further includes at least one limiting assembly which has a positioning aperture 109, a positioning column 110, an elastic component 111 and a stop component 112. The positioning aperture 109 is formed in the paper pressing plate 104. The positioning column 110 matches the positioning aperture 109 in position, one end of the positioning column 110 is fixed to an inner side of the cover plate 105, and the other end of the positioning column 110 penetrates through the positioning aperture 109. The stop component 112 is connected to the end, away from the cover plate 105, of the positioning column 110, and the peripheral size of the stop component 112 is greater than the diameter of the positioning aperture 109, so that the free end of the paper pressing plate 104 is able to move between the two ends of the positioning column 110. One end of the elastic component 111 is fixed to a lower surface of the paper pressing plate 104, and the other end of the elastic component 111 is fixed to the spindle 106. When the user opens the cover plate 105, the stop component 112 drives the paper pressing plate 104 to turn upwards along the positioning column 110, and the elastic component 111 is in stretched state. When the user closes the cover plate 105, the elastic component 111 contracts to automatically drive the paper pressing plate 104 to turn downwards along the positioning column 110 to enable the paper pressing plate 104 press against an upper surface of the stack of to-be-shredded paper, and the elastic component 111 is in a contracted state.

Figure 1:
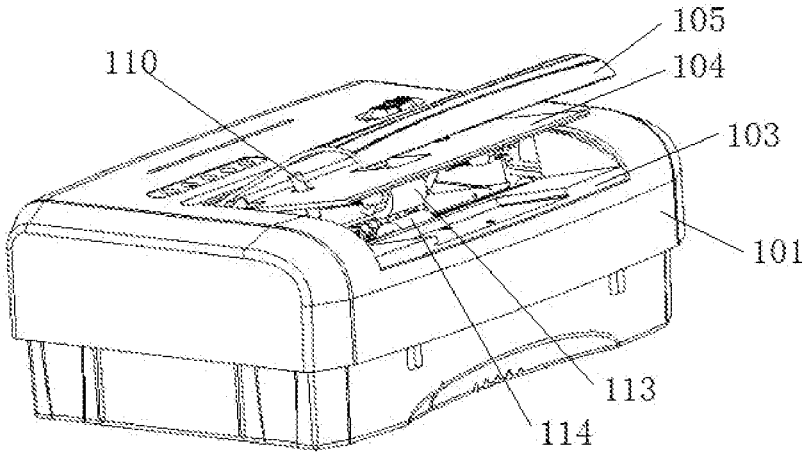
FIG. 1 is a structural view of a cover plate, in an open state, of a paper pressing mechanism for an automatic shredder embodiment of the invention.
Figure 2:
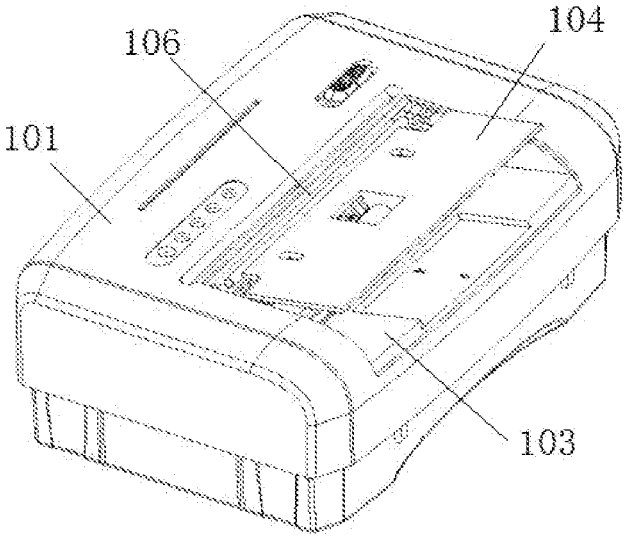
FIG. 2 is a structural view of the paper pressing mechanism, with the cover plate being hidden, for an automatic shredder embodiment of the invention.
Figure 3:
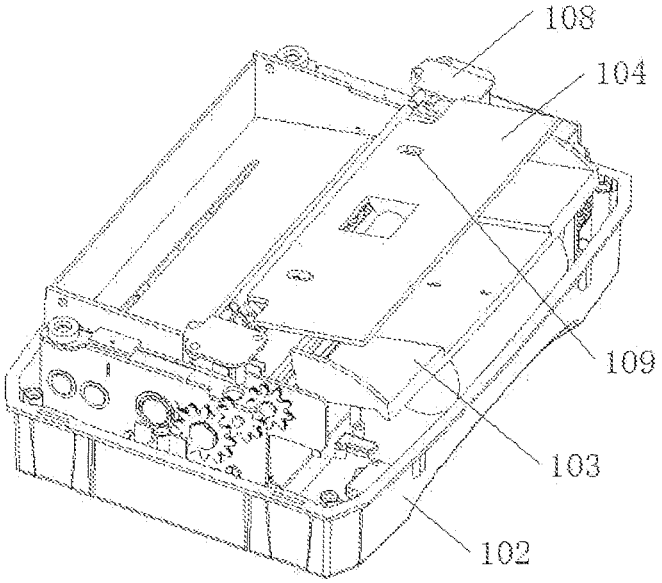
FIG. 3 is a structural view of the paper pressing mechanism, with an upper shredder cover and the cover plate being hidden, for an automatic shredder embodiment of the invention.
Figure 4:
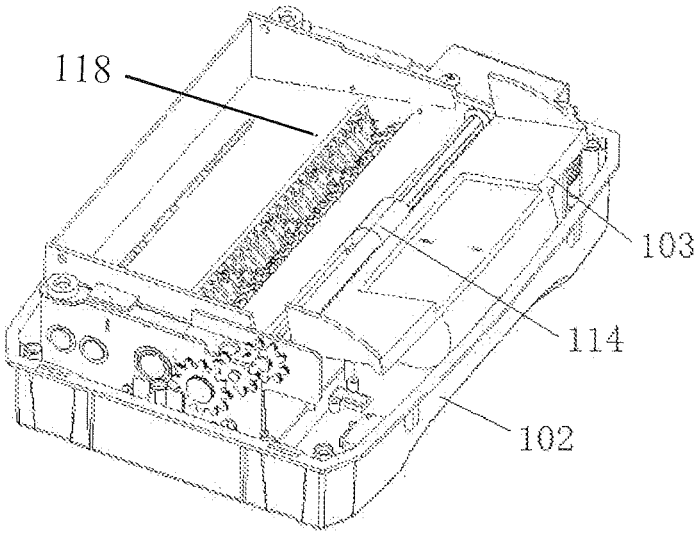
FIG. 4 is a structural view of the paper pressing mechanism, with the upper shredder cover and a paper pressing plate being hidden, for an automatic shredder embodiment of the invention.
Figure 5:
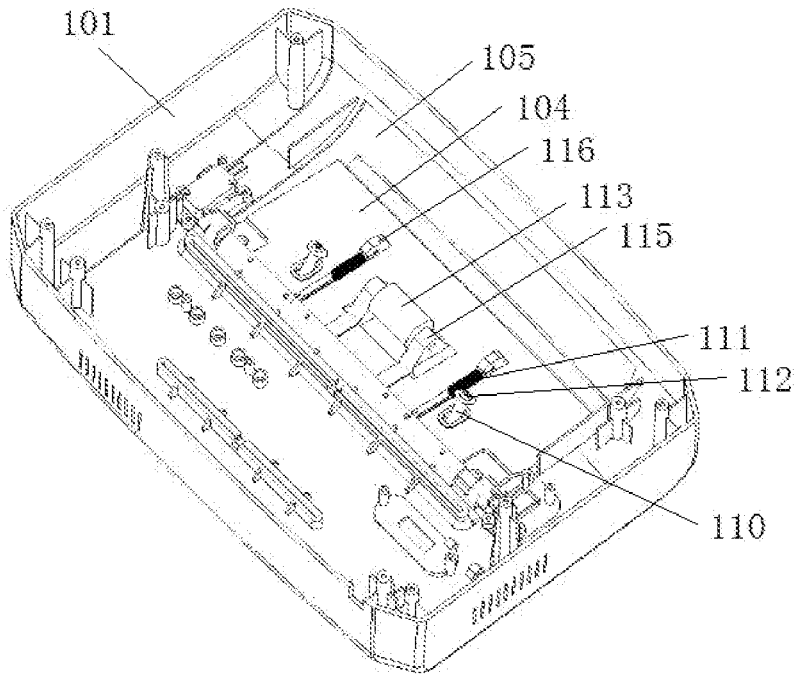
FIG. 5 is a bottom view of the upper shredder cover of the paper pressing mechanism for an automatic shredder embodiment of the invention.
Figure 11:
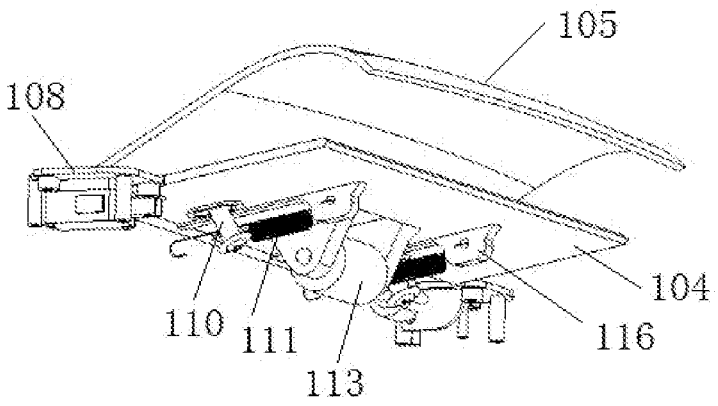
FIG. 11 is a perspective view of the matching structure of the cover plate and the paper pressing plate of the paper pressing mechanism for an automatic shredder embodiment of the invention.

In embodiments, as shown in FIG. 5, FIG. 10 and FIG. 11, the paper pressing mechanism includes two limiting assemblies, which are distributed left and right to ensure uniform stress of the two sides of the paper pressing plate 104 and specifically include two positioning apertures 109, two positioning columns 110, two elastic components 111 and two stop components 112. The two positioning apertures 109 are symmetrically formed in the paper pressing plate 104. One ends of the two positioning columns 110 are symmetrically arranged on the inner side of the cover plate 105, and the other ends of the two positioning columns 110 penetrate through the two positioning apertures 109 respectively and match the two positioning apertures 109 in position. In this embodiment, the positioning columns 110 and the cover plate 105 are manufactured integrally to effectively reduce the installation cost, or are detachably connected and fixed through the cooperation of internal and external threads, or are fixedly connected in other manners.

The two stop components 112 are respectively connected to the ends, away from the cover plate 105, of the two positioning columns 110, and the peripheral sizes of the two stop components 112 correspond to the diameters of the two positioning apertures 109. As shown in FIG. 5 and FIG. 9, FIG. 10, and FIG. 11, the stop components 112 are screws in this embodiment. In embodiments, the stop components 112 may be screws, nuts, bolts, clamping pin, positioning pins, stop pins or other components that can fulfill a limit effect.

One ends of the two elastic components 111 are fixed to a lower surface of the paper pressing plate 104, and the other ends of the two elastic components 111 are connected to the spindle 106 in a hooked manner. In a preferred embodiment, the elastic components 111 are tension springs have one ends fixedly connected to elastic component holders 116 on the lower surface of the paper pressing plate 104 and the other ends connected to the spindle 106 in a hooked manner. In embodiments, when the number of the tension springs is greater than or equal to two, the distance from joints of one ends of the plurality of tension springs and the elastic component holders 116 to the spindle 106 are equal, and the distances from the joints of one ends of the plurality of tension springs and the elastic component holders 116 to the lower surface of the paper pressing plate 104 are also equal, so that tensile forces applied to all positions of the paper pressing plate 104 by the torsion springs are uniform, the stress borne by the stack of to-be-shredded paper on the paper support box 103 is also uniform, and paper dislocation caused by non-uniform stress applied to the stack of to-be-shredded paper is avoided.

Figure 8:
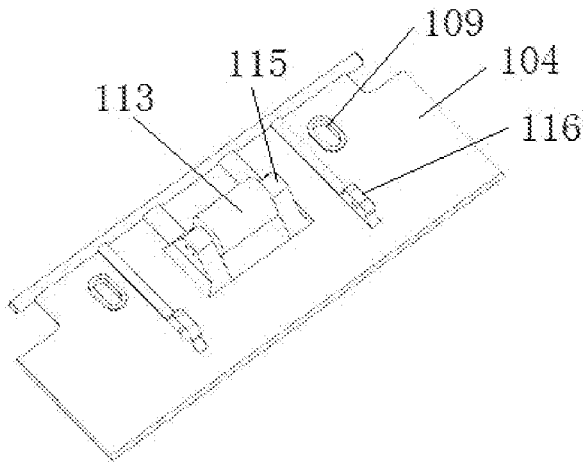
FIG. 8 is a structural view of the paper pressing plate of the paper pressing mechanism of an automatic shredder embodiment of the invention.
Figure 9:
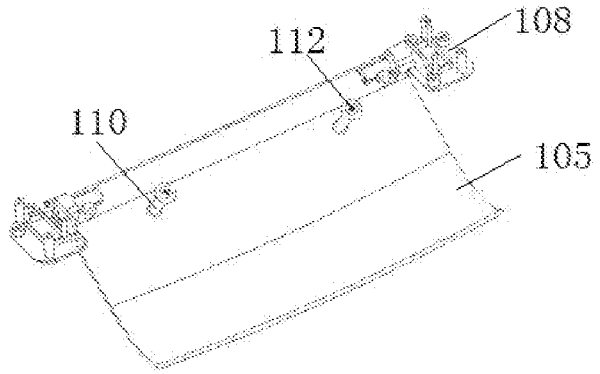
FIG. 9 is a structural view of the cover plate of the paper pressing mechanism for an automatic shredder embodiment of the invention.

In embodiments, the positioning apertures 109 may be linear, oval or oblong. As shown in FIG. 8, the positioning apertures 109 are oblong optimally, in which the diameter of two semicircular parts is slightly greater than that of the positioning columns 110, and the distance between two straight side plates is slightly greater than the diameter of the positioning columns 110, so that the positioning columns 110 can turn and move in the positioning apertures 109 along with the paper pressing plate 104. In embodiments, long edges of the positioning apertures 109 are perpendicular to the long axis of the spindle 106, so that the paper pressing plate 104 can turn smoothly and will not get stuck.

Furthermore, the paper pressing mechanism further includes at least one paper pick-up roller set which includes an upper paper pick-up roller 113 and a lower paper pick-up roller 114. The upper paper pick-up roller 113 is fixed between two upper paper pick-up roller seats 115 at a lower end of the paper pressing plate 104 through an upper paper pick-up roller spindle (not shown). The lower paper pick-up roller 114 is fixed to two sides of the lower shredder cover 102 or between two lower paper pick-up roller seats (not shown) at a lower end of the paper support box 103 through a lower paper pick-up roller spindle (not shown). The lower paper pick-up roller 114 partially protrudes out an upper surface of the paper support box 103 and corresponds to the upper paper pick-up roller 113 in position, so that when the user closes the cover plate 105, the upper paper pick-up roller 113 on the paper pressing plate 104 presses against the stack of to-be-shredded paper on the paper support box 103 and coordinates with the lower paper pick-up roller 114 to enable one or more bottom pieces of paper in the stack of to-be-shredded paper to enter a paper inlet in the paper support box 103.

In one embodiment, as shown in FIG. 5, FIG. 8, FIG. 10 and FIG. 11, the paper pressing mechanism has one paper pick-up roller set, in which the upper pick-up roller 113 is located on a middle section of the inner side of the paper pressing plate 104, and the lower paper pick-up roller 114 is located on a middle section of one side of the paper inlet in the paper support box 103 and corresponds to the upper pick-up roller 113 in position. Optionally, the upper paper pick-up roller 113 and the lower paper pick-up roller 114 are respectively located in the middle of the paper pressing plate 104 and in the middle of one side of the paper inlet in the paper support box 103 respectively, so that it can be effectively ensured that the stress applied to the stack of to-be-shredded paper on the paper support box 103 on two sides of the paper pick-up roller set is uniform.

In another embodiment, the paper pressing mechanism includes two paper pick-up roller sets which are symmetrically distributed on the inner side of the paper pressing plate 104 and on one side of the paper inlet in the paper support box 103 respectively. The design of the two paper pick-up roller sets can effectively improve the paper pick-up force and the paper pick-up efficiency. In embodiments, the upper paper pick-up roller spindle is parallel to the lower surface of the paper pressing plate 104, the lower paper pick-up roller spindle is parallel to the upper surface of the paper support box 103, and the force applied to the upper surface of the stack of to-be-shredded paper by the upper paper pick-up roller 113 is equal to the force applied to the lower surface of the stack of to-be-shredded paper by the lower paper pick-up roller 114, so that paper pick-up smoothness is effectively ensured, and paper tilting is avoided.

A Specific Operating Principle of Embodiment 1

After the user opens the cover plate 105, the paper pressing plate 104 is driven by the stop component 112 to turn upwards along the positioning column 110, and the elastic component 111 (tension spring) on the lower surface of the paper pressing plate 104 is stretched. At this moment, a stack of to-be-shredded paper is placed on the paper support box 103, the cover plate 105 is released, the elastic component 111 (tension spring) on the lower surface of the paper pressing plate 104 contracts to automatically drive the paper pressing plate 104 to turn downwards along the positioning column 110, the cover plate 105 turns downward synchronously, the upper paper pick-up roller 113 presses against the upper surface of the stack of to-be-shredded paper and coordinates with the lower paper pick-up roller 114 on the paper support box 103 to pick up paper.

Representative Embodiment 2

Figure 15:
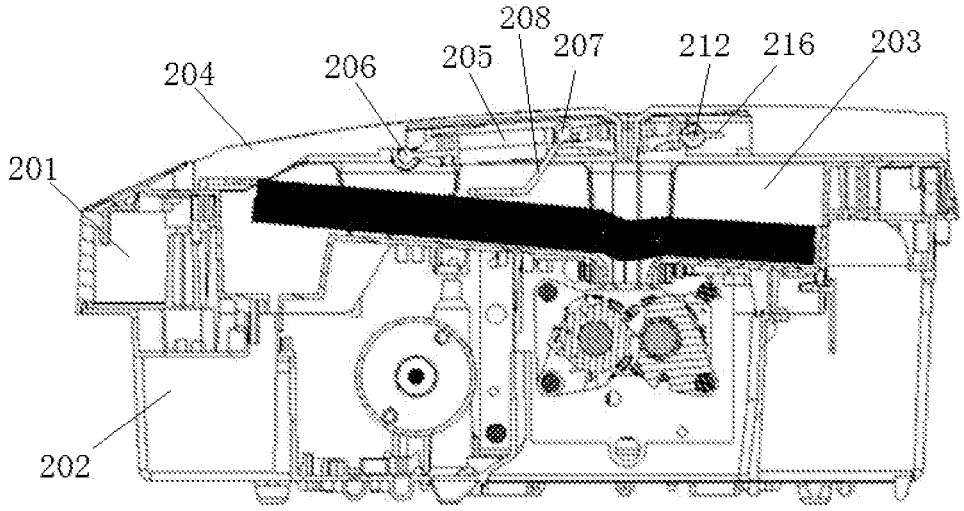
FIG. 15 is a sectional view of the big pressing plate (or small pressing plates) returning to an original position after paper is placed in the paper pressing structure for an automatic shredder embodiment of the invention.
Figure 16:
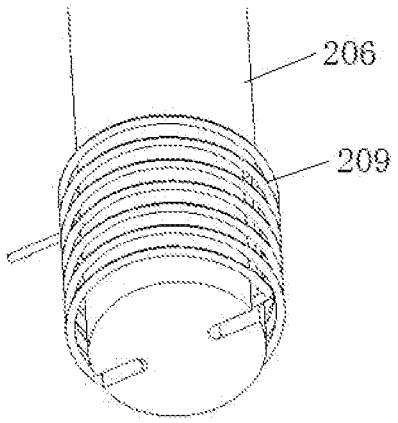
FIG. 16 is a matching diagram of a spindle torsion spring and a base plate spindle of the paper pressing structure for an automatic shredder embodiment of the invention.
Figure 17:
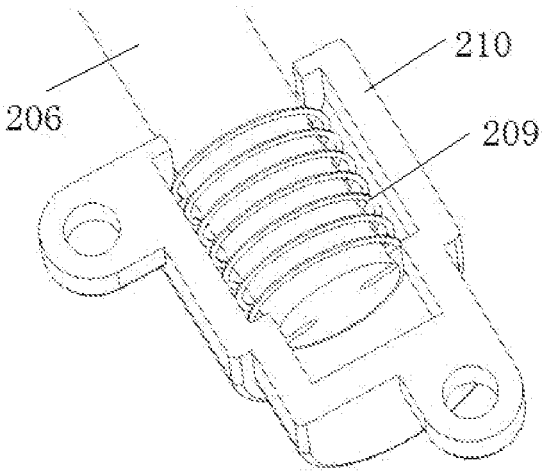
FIG. 17 is a matching diagram of the spindle torsion spring and a base plate spindle holder of the paper pressing structure for an automatic shredder embodiment of the invention.

As shown in FIG. 12-FIG. 26, the embodiments include an automatic shredder, having a paper pressing structure, which is commonly used in a case where user paper (e.g., A4- or Letter-sized) cannot be flatly placed on a paper support box (similar to a common automatic shredder) and specifically includes an upper shredder cover 201, a lower shredder cover 202, a paper support box 203, a shredder cover 204, a paper pressing base plate 205, a base plate spindle 206, big pressing plate torsion springs (not shown), a pressing plate spindle 207, a big pressing plate 208, two spindle torsion springs 209, two base plate spindle holders 210 and two pressing plate spindle holders 211. The upper shredder cover 201 is vertically and fixedly connected to the lower shredder cover 202. The paper support box 203 is concavely disposed above the lower shredder cover 202 to form an accommodating cavity for accommodating a stack of to-be-shredded paper. The shredder cover 204 is connected to one end of the upper shredder cover 201 through a pivot and is used for closing or opening the shredder. One end of the paper pressing base plate 205 is fixedly connected to the base plate spindle 206. The two spindle tension springs 209 are separately disposed around two ends of the base plate spindle 206 and are respectively arranged in the two base plate spindle holders 210 located at the two ends of the base plate spindle 206, so that the base plate spindle 206 is able to rotate to drive the paper pressing base plate 205 to rotate, as shown in FIG. 16 and FIG. 17. The two base plate spindle holders 210 are fixedly connected to an inner side of the shredder cover 204 to fixedly connect the paper pressing base plate 205 to the inner side of the shredder cover 204. In this embodiment, the connection manner of the base plate spindle holders 210 and the shredder cover 204 is not limited, and any fixed connection manner such as screwed connection, clamped connection and welded connection can be adopted.

The two big pressing plate tension springs are separately disposed around two ends of the pressing plate spindle 207 and are respectively arranged in the two pressing plate spindle holders 211 located at the two ends of the pressing plate spindle 207, so that the pressing plate spindle 207 is able to rotate to drive the big pressing plate 208 to rotate. In this embodiment, the connection manner of the pressing plate spindle holders 211 and the paper pressing base plate 205 is not limited either, and any fixed connection manner such as screwed connection, clamped connection and welded connection can be adopted.

The big pressing plate 208 is rotatably connected to the paper pressing base plate 205 from below through the pressing plate spindle 207 and is used for pressing the stack of to-be-shredded paper placed on the paper support box 203 when a user closes the shredder cover 204.

Figure 12:
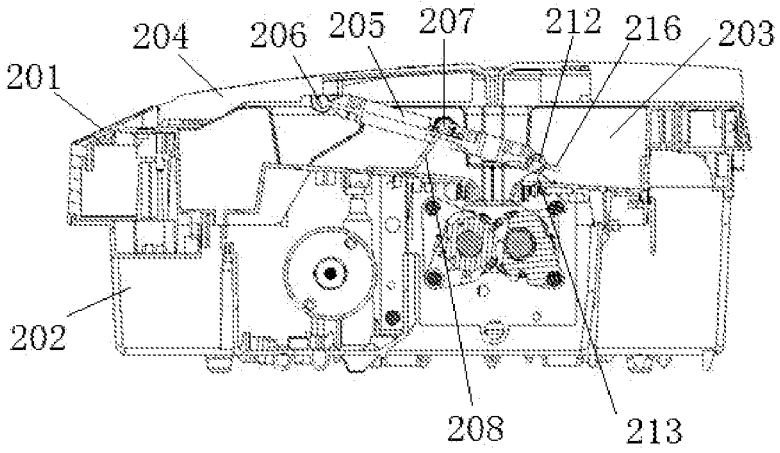
FIG. 12 is sectional view of a big pressing plate (or small pressing plates), pressed in place, of a paper pressing structure for an automatic shredder embodiment of the invention.
Figure 13:
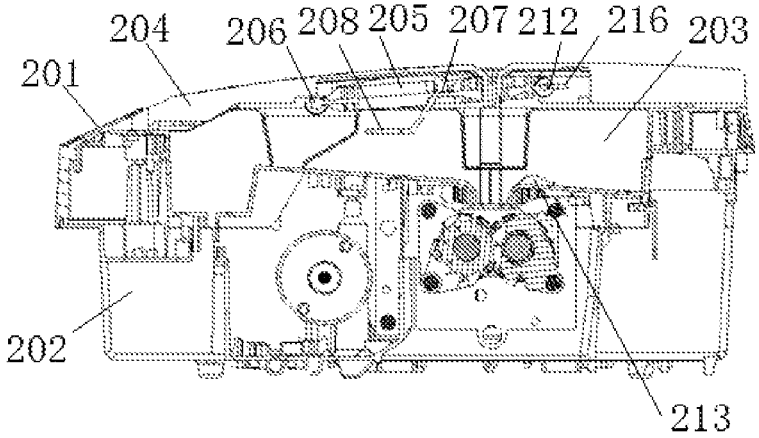
FIG. 13 is a sectional view of the big pressing plate (or small pressing plates), returning to an original position, of the paper pressing structure for an automatic shredder embodiment of the invention.

As shown in FIG. 12 and FIG. 13, the paper pressing structure further includes at least one paper pick-up roller set including an upper paper pick-up roller 212 and a lower paper pick-up roller 213. The upper pick-up roller 212 is fixed between two upper paper pick-up roller spindle holders 215 at the end, away from the base plate spindle 206, of the paper pressing base plate 205 through an upper paper pick-up roller spindle 214. The lower paper pick-up roller 213 is fixed to two sides of the lower shredder cover 202 or between two lower paper pick-up roller spindle holders (not shown) at a lower end of the paper support box 203 through a lower paper pick-up roller spindle (not shown). In this embodiment, the lower paper pick-up roller 213 is located on a side, close to a pivot joint of the shedder cover 204 and the upper shredder cover 201, of a paper inlet.

The lower paper pick-up roller 213 partially protrudes out of an upper surface of the paper support box 203 and corresponds to the upper paper pick-up roller 212 in position. When the user closes the shredder cover 204, the upper pick-up roller 212 on the paper pressing base plate 205 presses against the stack of to-be-shredded paper on the paper support box 203 and coordinates with the lower paper pick-up roller 213 to enable one or more bottom pieces of paper in the stack of to-be-shredded paper to enter the paper inlet in the paper support box 203. In this embodiment, when one paper pick-up roller set is configured, the paper pick-up roller set is arranged in the middle. When two paper pick-up roller sets are configured, the two paper pick-up roller sets are symmetrically arranged, as shown in FIG. 19, FIG. 20, and FIG. 22-FIG. 24.

Furthermore, a paper pressing strip 216 is disposed at the end, away from the base plate spindle 206, of the paper pressing base plate 205, is integrated with the paper pressing base plate 205, and is used for pressing a few pieces of to-be-shredded paper on the paper support box 203 to an upper surface of the paper support box 203, so that the staple removing efficiency and effect can be indirectly improved. In this embodiment, the paper pressing strip 216, the upper paper pick-up roller spindle holders 215 and the paper pressing base plate 205 are manufactured integrally. In actual operation, the paper pressing strip 216 may be divided into a plurality of paper pressing blocks which are arranged at equal or unequal intervals, and optimally, the paper pressing blocks are arranged at equal intervals.

Figure 18:
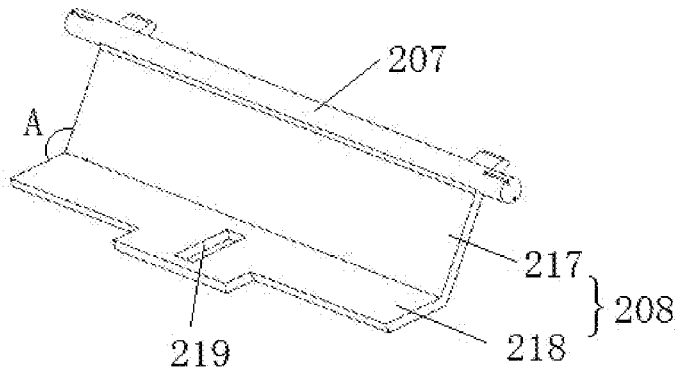
FIG. 18 is a structural view of a big pressing plate of the paper pressing structure for an automatic shredder embodiment of the invention.
Figure 19:
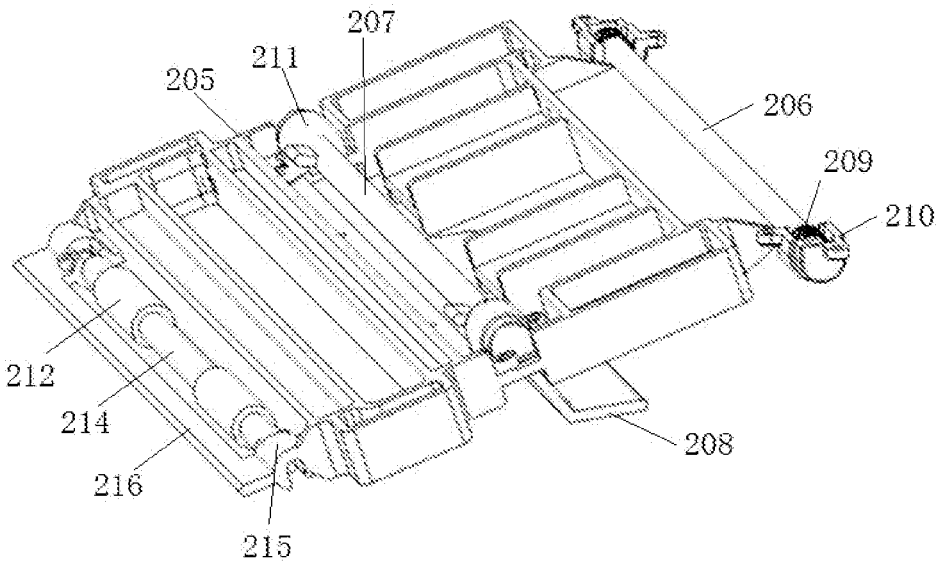
FIG. 19 is a top view of a matching structure of the big pressing plate and a paper pressing base plate of the paper pressing structure for an automatic shredder embodiment of the invention.
Figure 20:
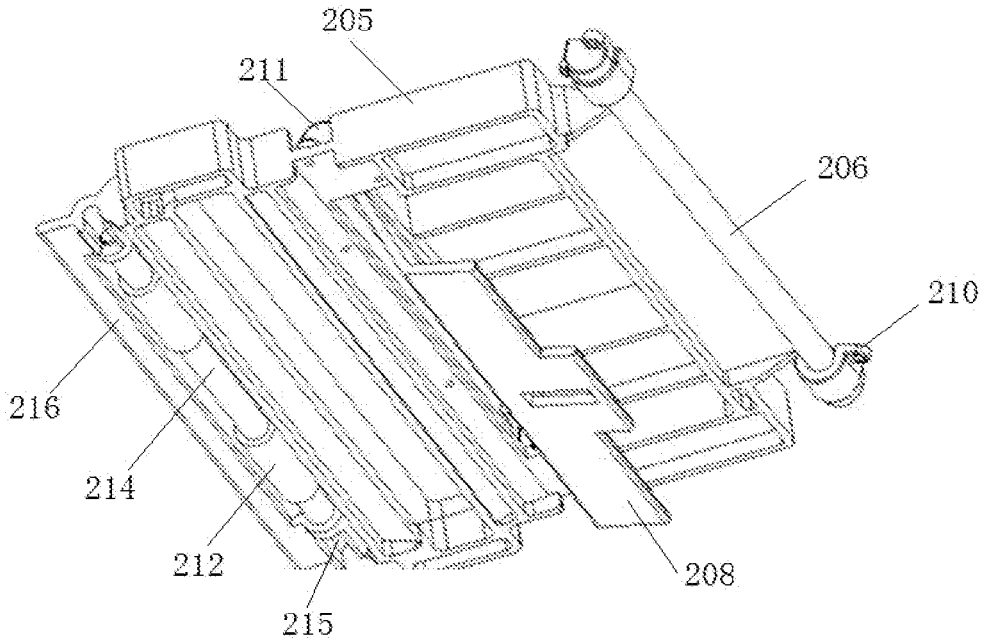
FIG. 20 is a bottom view of the matching structure of the big pressing plate and the paper pressing base plate of the paper pressing structure for an automatic shredder embodiment of the invention.

Continuing to refer to FIG. 18, the big pressing plate 208 has a big connecting plate 217 and a big paper pressing plate 218, in which the big paper pressing plate 218 is, when the paper pressing base plate 205 is naturally released, attached to the upper surface of the paper support box 203 to press the stack of to-be-shredded paper to the upper surface of the paper support box 203, so that the staple removing efficiency and effect can be effectively improved.

Furthermore, a first through-aperture 219 is formed in the big paper pressing plate 218 and matches a travel switch, partially upward protruding out of the paper support box 203, in position, so that when the stack of to-be-shredded paper on the paper support box 203 is about to be completely shredded or has been completely shredded, the travel switch can be received in the first through-aperture 219 and can feed back the paper shredding condition in time.

In FIG. 18, an angle A between the big connecting plate 217 and the big paper pressing plate 218 is greater than or equal to 90 degrees. In actual operation, the angle is preferably greater than 90 degrees, so that the travel distance of the paper pressing base plate can be effectively reduced, the paper pressing structure is simpler, and space is saved. In embodiments, the big connecting plate 217 and the big paper pressing plate 218 are manufactured integrally, so that the service life of the big pressing plate 208 can be effectively prolonged, and damage caused by repeated paper pressing is avoided.

In another embodiment, as shown in FIG. 21-FIG. 24, the big pressing plate 208 is divided into a plurality of small pressing plates 220 each including a small connecting plate 221 and a small paper pressing plate 222, and each small paper pressing plate 222 is, when the paper pressing base plate 205 is naturally released, attached to the upper surface of the paper support box 203 to press the stack of to-be-shredded paper to the upper surface of the paper support box 203, so that the staple removing efficiency and effect can be effectively improved.

Figure 23:
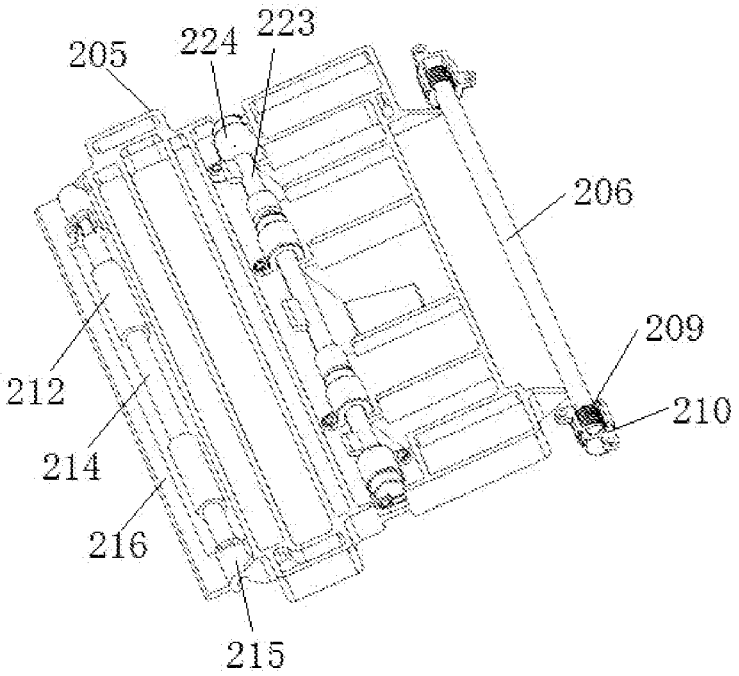
FIG. 23 is a top view of a matching structure of the small pressing plates and the paper pressing base plate of the paper pressing structure having the pressing plate spindle divided into a plurality of small pressing plate spindles for an automatic shredder embodiment of the invention.
Figure 24:
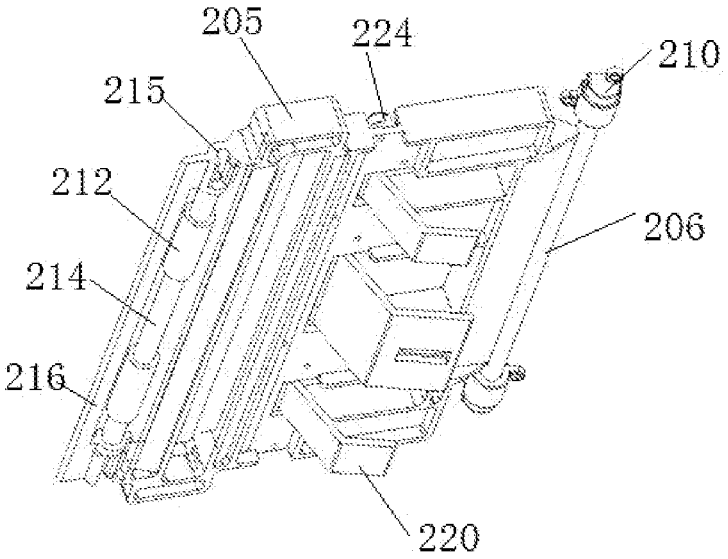
FIG. 24 is a bottom view of the matching structure of the small pressing plates and the paper pressing base plate of the paper pressing structure having the pressing plate spindle divided into a plurality of small pressing plate spindles for an automatic shredder embodiment of the invention.

As shown in FIG. 23 and FIG. 24, when the pressing plate spindle 207 is divided into a plurality of small pressing plate spindles 223, the number of the small pressing plate spindles 223 is equal to that of the small pressing plates 220, and the small connecting plates 221 of the plurality of small pressing plates 220 are fixedly connected to the plurality of small pressing plate spindles 223 respectively, and are fixedly connected to the paper pressing base plate 205 through small pressing plate torsion springs (not shown) and small pressing plate spindle holders 224 at two ends of the small pressing plate spindles 223. In this embodiment, the number of the plurality of small pressing plate spindles 223 is not limited.

Figure 22:
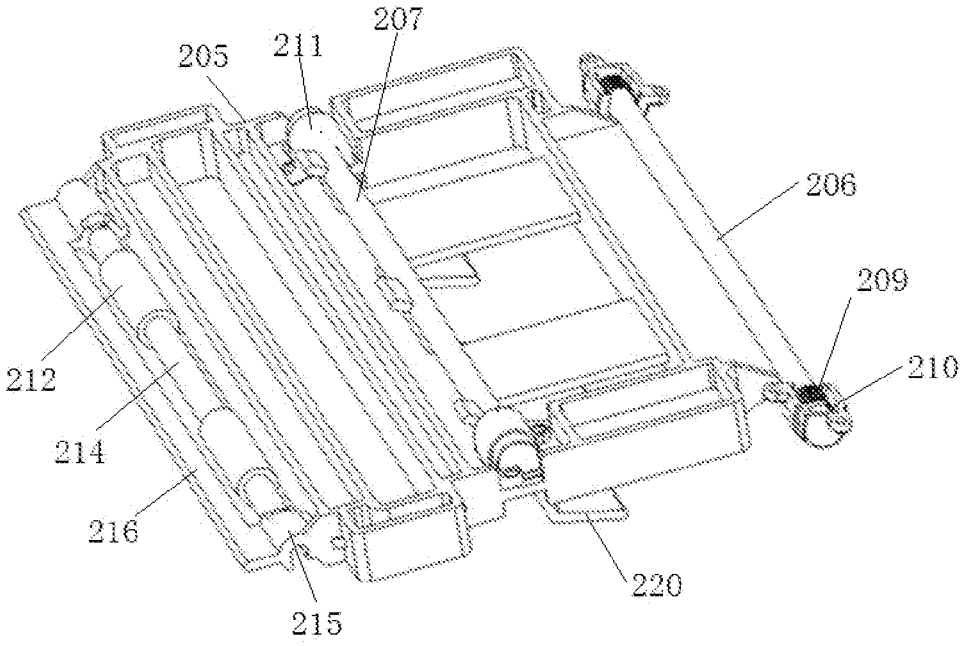
FIG. 22 is a top view of a matching structure the small pressing plates and the paper pressing base plate of the paper pressing structure having a pressing plate spindle of an integrated structure for an automatic shredder embodiment of the invention.

Alternatively, as shown in FIG. 22, when the pressing plate spindle 207 is of an integrated structure, the small connecting plates 221 of the plurality of small pressing plates 220 are fixedly connected to the pressing plate spindle 207, and are fixedly connected to the paper pressing base plate 205 through the big pressing plate torsion springs and the pressing plate spindle holders 211 at the two ends of the pressing plate spindle 207. By adoption of the pressing plate spindle 207 of the integrated structure, the cost of the multiple small pressing plate spindles 223 and the small pressing plate spindle holders 224 matched with the small pressing plate spindles 223 can be effectively saved, and the consistency of rotation angles of the small pressing plates 220 can be better guaranteed.

Figure 21:
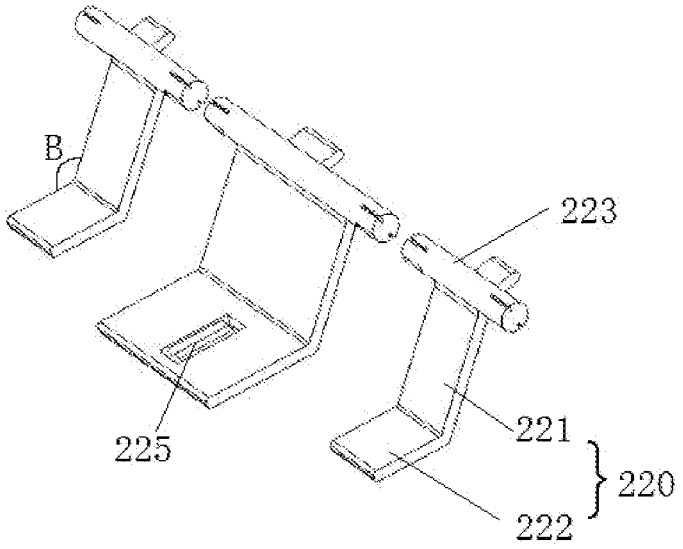
FIG. 21 is a structural view of small pressing plates of the paper pressing structure for an automatic shredder embodiment of the invention.

Further referring to FIG. 21 and FIG. 24, a second through-aperture 225 is formed in the small paper pressing plate 222, located in the middle, of the plurality of small paper pressing plates 222, and matches a travel switch, partially upward protruding out of the paper support box 203, in position, so that when the stack of to-be-shredded paper on the paper support box 203 is about to be completely shredded or has been completely shredded, the travel switch can be received in the second through-aperture 225 and can feed back the paper shredding condition in time.

As shown in FIG. 21, angles between the small connecting plates 221 and the small paper pressing plates 222 are equal and are greater than or equal to 90 degrees. In actual operation, the angles are generally greater than 90 degrees, so that the travel distance of the paper pressing base plate can be effectively reduced, the paper pressing structure is simpler, and the space is saved. In embodiments, each small connecting plate 221 and the corresponding small paper pressing plate 222 are manufactured integrally, so that the service life of the small pressing plates 220 can be effectively prolonged, and damage caused by repeated paper pressing is avoided. In addition, it can be indirectly ensured that the angles between the small connecting plates 221 and the small paper pressing plates 222 are equal to make the stress applied on the upper surface of the stack of to-be-shredded paper on the paper support box 203 more uniform.

In this embodiment, corresponding to the configuration that the paper pick-up roller set is located on the side, close to the pivot joint of the shredder cover 204 and the upper shredder cover 201, of the paper inlet, the base plate spindle 206 is disposed away from the pivot join of the shredder cover 204 and the upper shredder cover 201, and the big pressing plate 208 (or the plurality of small pressing plates 220) are located on a side, away from the pivot joint, of the shredder cover 204 and the upper shredder cover 201, of the paper inlet, correspondingly. In this way, it can be effectively ensured that the bottom piece of paper in the stack of to-be-shredded paper on two sides of the paper inlet can be upward fed into the paper inlet from two sides.

A Specific Operating Principle of Embodiment 2

Figure 14:
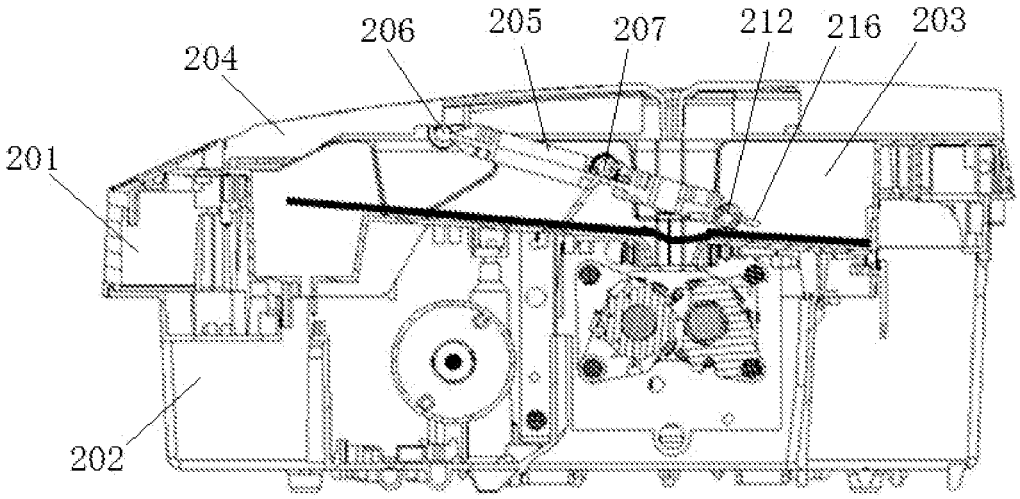
FIG. 14 is a sectional view of the big pressing plate (or small pressing plates), in pressed state at the end of paper shredding, of the paper pressing structure for an automatic shredder embodiment of the invention.
Figure 25:
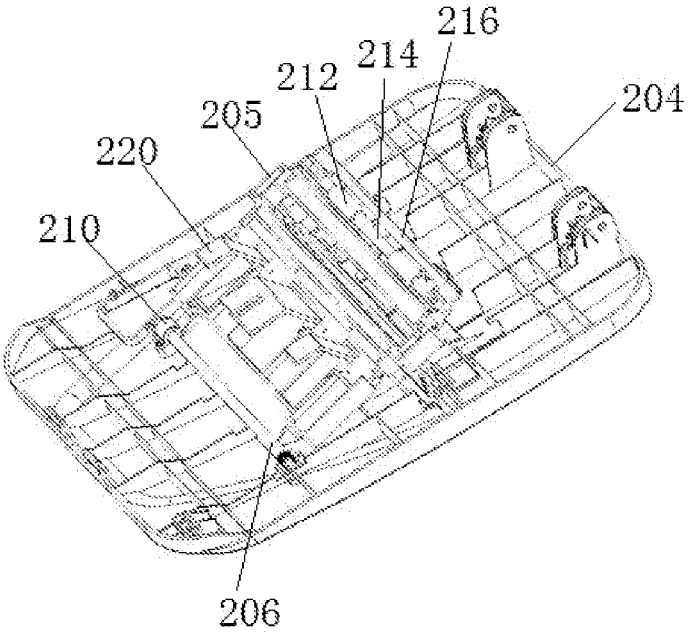
FIG. 25 is a structural view of the paper pressing base plate, to be released, of the paper pressing structure for an automatic shredder embodiment of the invention.
Figure 26:
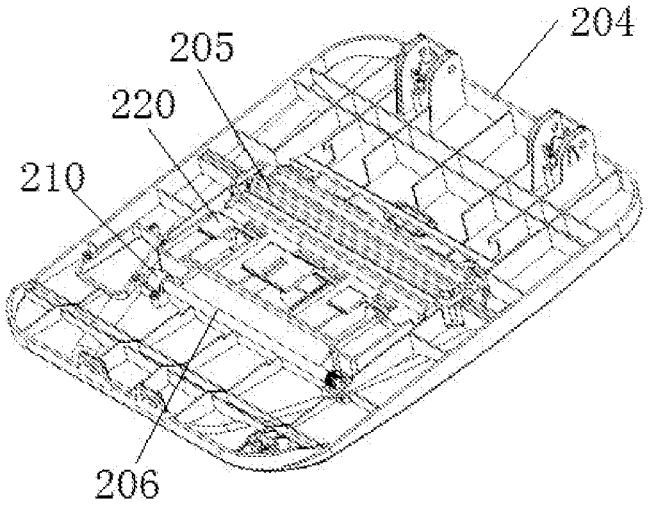
FIG. 26 is a structural view of the paper pressing base plate, returning to a limit position, of the paper pressing structure for an automatic shredder embodiment of the invention.

When the user opens the shredder cover 204, the paper pressing base plate 205 is naturally released (as shown in FIG. 25) under gravity. A stack of to-be-shredded paper is placed on the paper support box 203, and then the shredder cover 204 is closed. The big pressing plate 208 (the plurality of small pressing plates 220) on the paper pressing base plate 205 presses against the upper surface of the stack of to-be-shredded paper, and the paper pressing base plate 205 is squeezed to return (as shown in FIG. 15). With the decrease of the stack of to-be-shredded paper, the paper pressing base plate 205 descends, the upper paper pick-up roller 212 gradually presses the upper surface of the stack of to-be-shredded paper, and the paper pressing strip 216 presses against the upper surface of the stack of to-be-shredded paper at the same time (as shown in FIG. 14), so that the paper pick-up efficiency can be effectively improved.

The foregoing description is merely for explaining preferred specific implementations of the invention, but is not intended to the limit the protection scope of the invention. All transformations or substitutions easily obtained by anyone skilled in the art should fall within the protection scope of the invention. Thus, the protection scope of the invention should be subject to the protection scope defined by the claims.

What is claimed is:

1. An automatic shredder, comprising: a paper pressing mechanism; a cutting mechanism; an upper shredder cover; a lower shredder cover; a paper support box; a paper pressing plate; a cover plate; a spindle; and two spindle holders, wherein: the upper shredder cover is vertically and fixedly connected to the lower shredder cover, the paper support box is concavely disposed above the lower shredder cover to form an accommodating cavity for accommodating a stack of to-be-shredded paper, fixed ends of the paper pressing plate and the cover plate are disposed around the spindle, so that free ends of the paper pressing plate and the cover plate are able to rotate coaxially, two ends of the spindle are respectively disposed in the two spindle holders, so that the spindle is able to rotate, the two spindle holders are fixedly connected to the upper shredder cover to fixedly connect the cover plate and the paper pressing plate to the upper shredder cover, the paper pressing plate is disposed below the cover plate and is used for pressing the stack of to-be-shredded paper placed on the paper support box when a user closes the cover plate;

wherein at least one limiting assembly, including: a positioning aperture, a positioning column, an elastic component and a stop component, wherein: the positioning aperture is formed in the paper pressing plate, and the positioning aperture is linear, oval or oblong, the positioning column matches the positioning aperture in position and has an end fixed to an inner side of the cover plate and an end penetrating through the positioning aperture, the stop component is connected to the end, away from the cover plate, of the positioning column and has a peripheral size greater than a diameter of the positioning aperture, so that the free end of the paper pressing plate is able to move between the two ends of the positioning column, the elastic component has an end fixed to a lower surface of the paper pressing plate and an end fixed to the spindle, wherein: when the user opens the cover plate, the stop component drives the paper pressing plate to turn upwards along the positioning column, and the elastic component is in a stretched state, and when the user closes the cover plate, the elastic component contracts to automatically drive the paper pressing plate to turn downwards along the positioning column to enable the paper pressing plate to press against an upper surface of the stack of to-be-shredded paper, and the elastic component is in a contracted state.

2. The automatic shredder according to claim 1, comprising: two limiting assemblies including: two positioning apertures, two positioning columns, two elastic components and two stop components, wherein: the two positioning apertures are symmetrically formed in the paper pressing plate, wherein each of the positioning apertures is linear, oval or oblong, the two positioning columns have one ends symmetrically disposed on the inner side of the cover plate and another ends respectively penetrating through the two positioning apertures and matching the two positioning apertures in position, the two stop components are respectively connected to the ends, away from the cover plate, of the two positioning columns and have peripheral sizes corresponding to diameters of the two positioning apertures, the two elastic components have one ends fixed to the lower surface of the paper pressing plate and another ends connected to the spindle in a hooked manner.

3. The automatic shredder according to claim 2, wherein each of the two elastic components is a tension spring having an end fixedly connected to an elastic component holder on the lower surface of paper pressing plate and an end connected to the spindle in a hooked manner.

4. The automatic shredder according to claim 3, wherein when the number of the tension springs is a plurality, distances from joints of one ends of the plurality of tension springs and the elastic component holders to the spindle are equal, and distances from the joints of one ends of the plurality of tension springs and the elastic component holders to the lower surface of the paper pressing plate are also equal, so that tensile forces applied to different positions of the paper pressing plate by the tension springs are uniform.

5. The automatic shredder according to claim 4, wherein long edges of the positioning aperture are perpendicular to a long axis of the spindle.

6. The automatic shredder according to claim 2, wherein the positioning column and the cover plate are manufactured integrally.

7. The automatic shredder according to claim 2, wherein the stop component is a screw, a nut, a bolt, a clamping pin, a positioning pin, or a stop pin.

8. The automatic shredder according to claim 1, wherein the elastic component is a tension spring having an end fixedly connected to an elastic component holder on the lower surface of paper pressing plate and an end connected to the spindle in a hooked manner.

9. The automatic shredder according to claim 1, wherein the positioning column and the cover plate are manufactured integrally.

10. The automatic shredder according to claim 1, wherein the stop component is a screw, a nut, a bolt, a clamping pin, a positioning pin, or a stop pin.

11. The automatic shredder according to claim 1, further comprising at least one paper pick-up roller set including an upper paper pick-up roller and a lower paper pick-up roller, wherein: the upper paper pick-up roller is fixed between two upper paper pick-up roller seats at a lower end of the paper pressing plate through an upper paper pick-up roller spindle; the lower paper pick-up roller is fixed to two sides of the lower shredder cover or between two lower paper pick-up roller seats at a lower end of the paper support box through a lower paper pick-up roller spindle; the lower paper pick-up roller partially protrudes out of an upper surface of the paper support box and corresponds to the upper paper pick-up roller in position, so that when the user closes the cover plate, the upper paper pick-up roller on the paper pressing plate presses against the stack of to-be-shredded paper on the paper support box and coordinates with the lower paper pick-up roller to enable one or more bottom pieces of paper in the stack of to-be-shredded paper to enter a paper inlet in the paper support box.

12. The automatic shredder according to claim 11, comprising one paper pick-up roller set, wherein the upper paper pick-up roller is located on a middle section of an inner side of the paper pressing plate, and the lower paper pick-up roller set is located on a middle section of one side of the paper inlet in the paper support box and corresponds to the upper paper pick-up roller in position.

13. The automatic shredder according to claim 11, comprising two paper pick-up roller sets which are symmetrically distributed on an inner side of the paper pressing plate and on one side of the paper inlet in the paper support box, respectively.

14. The automatic shredder according to claim 11, wherein the upper paper pick-up roller spindle is parallel to a lower surface of the paper pressing plate, and the lower paper pick-up roller spindle is parallel to the upper surface of the paper support box.

15. The automatic shredder according to claim 1, further comprising two torsion springs which are separately disposed around the two ends of the spindle and are respectively arranged in the two spindle holders at the two ends of the spindle to realize the rotation of the spindle.

16. An automatic shredder, comprising a paper pressing structure; a cutting mechanism; an upper shredder cover; a lower shredder cover; a paper support box; a shredder cover; a paper pressing base plate; a base plate spindle; big pressing plate torsion springs; a pressing plate spindle; a big pressing plate; two spindle torsion springs; two base plate spindle holders; and two pressing plate spindle holders, wherein: the upper shredder cover is vertically and fixedly connected to the lower shredder cover; the paper support box is concavely disposed above the lower shredder cover to form an accommodating cavity for accommodating a stack of to-be-shredded paper; the shredder cover is connected to one end of the upper shredder cover through a pivot and is used for opening or closing the shredder; one end of the paper pressing base plate is fixedly connected to the base plate spindle; the two spindle torsion springs are separately disposed around two ends of the base plate spindle and are respectively arranged in the two base plate spindle holders at the two ends of the base plate spindle, so that the base plate spindle is able to rotate to drive the paper pressing base plate to rotate; the two base plate spindle holders are fixedly connected to an inner side of the shredder cover to fixedly connect the paper pressing base plate to the inner side of the shredder cover; the two big pressing plate torsion springs are separately disposed around two ends of the pressing plate spindle and are respectively arranged in the two pressing plate spindle holders at the two ends of the pressing plate spindle, so that the pressing plate spindle is able to rotate to drive the big pressing plate to rotate; the big pressing plate is rotatably connected to the paper pressing base plate from below through the pressing plate spindle and is used for pressing the stack of to-be-shredded paper placed on the paper support box when a user closes the shredder cover.

17. The automatic shredder according to claim 16, wherein the base plate spindle is disposed away from a pivot joint of the shredder cover and the upper shredder cover.

18. The automatic shredder according to claim 16, further comprises at least one paper pick-up roller set including an upper paper pick-up roller and a lower paper pick-up roller, wherein: the upper paper pick-up roller is fixed between two upper paper pick-up roller seats at an end, away from the base plate spindle, of the paper pressing base plate through an upper paper pick-up roller spindle; the lower paper pick-up roller is fixed to two sides of the lower shredder cover or between two lower paper pick-up roller spindle holders at a lower end of the paper support box through a lower paper pick-up roller spindle; the lower paper pick-up roller partially protrudes out of an upper surface of the paper support box and corresponds to the upper paper pick-up roller in position, so that when the user closes the cover plate, the upper paper pick-up roller on the paper pressing base plate presses against the stack of to-be-shredded paper on the paper support box and coordinates with the lower paper pick-up roller to enable one or more bottom pieces of paper in the stack of to-be-shredded paper to enter a paper inlet in the paper support box.

19. The automatic shredder according to claim 16, wherein a paper pressing strip is disposed at an end, away from the base plate spindle, of the paper pressing base plate, is integrated with the paper pressing base plate, and is used for pressing a few pieces of to-be-shredded paper on the paper support box to an upper surface of the paper support box.

20. The automatic shredder according to claim 16, wherein the big pressing plate comprises a big connecting plate and a big paper pressing plate, and the big paper pressing plate is, when the paper pressing base plate is naturally released, attached to an upper surface of the paper support box to press the stack of to-be-shredded paper to the upper surface of the paper support box.

21. The automatic shredder according to claim 20, wherein a first through-aperture is formed in the big paper pressing plate and matches a travel switch, partially upward protruding out of the paper support box, in position, so that when the stack of to-be-shredded paper on the paper support box is about to be completely shredded or has been completely shredded, the travel switch can be received in the first through-aperture and can feed back a paper shredding condition in rea time.

22. The automatic shredder according to claim 20, wherein an angle between the big connecting plate and the big paper pressing plate is greater than or equal to 90 degrees.

23. The automatic shredder according to claim 20, wherein the big connecting plate and the big paper pressing plate are manufactured integrally.

24. The automatic shredder according to claim 20, wherein the big pressing plate is divided into a plurality of small pressing plates each including a small connecting plate and a small paper pressing plate, and each small paper pressing plate is, when the paper pressing base plate is naturally released, attached to an upper surface of the paper support box to press the stack of to-be-shredded paper to the upper surface of the paper support box.

25. The automatic shredder according to claim 24, the number of the small pressing plate spindles is equal to that of the small pressing plates, the small connecting plates of the plurality of small pressing plates are fixedly connected to the plurality of small pressing plate spindles respectively, and are fixedly connected to the paper pressing base plate through small pressing plate torsion springs and small pressing plate spindle holders at two ends of the small pressing plate spindles.

26. The automatic shredder according to claim 24, wherein a second through-aperture is formed in the small paper pressing plate, located in a middle, of the plurality of small paper pressing plates and matches a travel switch, partially upward protruding out of the paper support box, in position, so that when the stack of to-be-shredded paper on the paper support box is about to be completely shredded or has been completely shredded, the travel switch can be received in the second through-aperture and can feed back a paper shredding condition in real time.

27. The automatic shredder according to claim 24, wherein angles between the small connecting plates and the small paper pressing plates are equal and are greater than or equal to 90 degrees.

28. The automatic shredder according to claim 24, wherein each small connecting plate and the corresponding small paper pressing plate are manufactured integrally.

* * * * *